US006527703B2

(12) United States Patent
Simmet

(10) Patent No.: US 6,527,703 B2
(45) Date of Patent: Mar. 4, 2003

(54) DEVICE FOR SOW-INTRA-UTERINE INSEMINATION AND EMBRYO TRANSFER

(75) Inventor: Ludwig O. Simmet, Verona, WI (US)

(73) Assignee: Minitube of America, Inc., Verona, WI (US)

( * ) Notice: Subject to any disclaimer, the term of this patent is extended or adjusted under 35 U.S.C. 154(b) by 0 days.

(21) Appl. No.: 09/883,135

(22) Filed: Jun. 14, 2001

(65) Prior Publication Data

US 2002/0193658 A1 Dec. 19, 2002

(51) Int. Cl.[7] ..... A61D 7/00

(52) U.S. Cl. ..... 600/33; 600/34; 600/35; 119/174

(58) Field of Search ..... 600/33, 34, 35; 119/108, 174

(56) References Cited

U.S. PATENT DOCUMENTS

| | | | | | |
|---|---|---|---|---|---|
| 3,791,384 | A | * | 2/1974 | Richter et al. | 128/260 |
| 3,811,443 | A | * | 5/1974 | Dickinson, III et al. | 128/235 |
| 4,071,027 | A | | 1/1978 | Meador | |
| 4,338,402 | A | * | 7/1982 | Suzuki | 435/287 |
| 4,432,753 | A | | 2/1984 | Cassou et al. | |
| 4,642,094 | A | | 2/1987 | North, Jr. et al. | |
| 4,701,164 | A | * | 10/1987 | Cassou et al. | 604/218 |
| 4,846,785 | A | | 7/1989 | Cassou et al. | |
| 4,865,589 | A | * | 9/1989 | Simmet et al. | 604/171 |
| 5,496,272 | A | * | 3/1996 | Chung et al. | 604/55 |
| 5,558,636 | A | | 9/1996 | Li et al. | |
| 5,656,010 | A | * | 8/1997 | Li et al. | 600/34 |
| 5,674,178 | A | * | 10/1997 | Root | 600/35 |
| 5,807,239 | A | | 9/1998 | DiBernardo | |
| 5,846,221 | A | | 12/1998 | Snoke et al. | |
| 5,863,286 | A | | 1/1999 | Yabe et al. | |
| 5,865,802 | A | | 2/1999 | Yoon et al. | |
| 5,899,848 | A | * | 5/1999 | Haubrich | 600/35 |
| 5,913,816 | A | | 6/1999 | Saners et al. | |
| 5,916,144 | A | | 6/1999 | Li et al. | |
| 5,935,056 | A | | 8/1999 | Kerin et al. | |

FOREIGN PATENT DOCUMENTS

WO WO 01/49206 A1 12/2000

OTHER PUBLICATIONS

"PATRIOT ™ Catheter" Continental Plastic Corp, Delavan, Wisconsin, prior to Feb. 27, 2001.
Spermnotes, vol. V, Issue 1, pp 1–3, Spring 2001.
Photos of Deep Golden Pig catheter assembly, taken May 3, 2001.
"Penetrating Innovations ™", pp. 27–28, Minitube of America, Verona, Wisconsin, 2000.
Photo 74—Minitube Germany catheter.
Photo 3—IMV catheter, prior to 2000.
Photo 15—catheter imported by Pig Tracks, a Wisconsin company.
Photo A—Minitube Transfer instrument disposable tip, prior to 2000.

* cited by examiner

*Primary Examiner*—Ira S. Lazarus
*Assistant Examiner*—Tu Cam Nguyen
(74) *Attorney, Agent, or Firm*—Lathrop & Clark LLP

(57) ABSTRACT

An internal catheter has a flexible plastic inner tube with an integrally formed protruding head with an axial channel. The internal catheter extends through an axial channel in an exterior catheter. With the internal catheter head withdrawn within the foam or spiral tip of the exterior catheter, the assembly is advanced into a sow cervix, and the internal catheter is then advanced through the tip of the catheter and remaining portion of the cervix and into the uterine body and possibly into a uterine horn. Semen or embryos are then introduced through the axial cavity. The tip of the exterior catheter may have a protective flap which is not penetrated until the inner tube is advanced therethrough. The internal catheter axial channel may have a constricted portion within the head, to engage a semen or embryo containing straw.

22 Claims, 5 Drawing Sheets

DEVICE FOR SOW-INTRA-UTERINE INSEMINATION AND EMBRYO TRANSFER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to devices for the artificial insemination of livestock in general, and more particularly to those for introducing boar semen or embryos into a sow uterus in particular.

Artificial insemination techniques have been employed in swine breeding not only for the improved control over breeding characteristics which they offer, but also for the increased efficiency and improved fertility which may be obtained.

In the conventional approach, boar semen is first collected, tested and packaged. This collection may take place within the same facility in which the sows reside, or semen may be collected at a remote location and transported to the place of insemination. When a particular sow is determined to be in heat, a technician introduces the distal foam or spiral end of an insemination catheter into the cervix of the sow. A quantity of boar semen is then introduced through the catheter into the uterus of the sow. The original collected semen will usually be diluted with an extender. To effectively inseminate the sow, and achieve the maximum desirable litter size, sperm cells must travel through the uterus into the coiled uterine horns and then down the oviduct to reach the ova so that fertilization can take place. Due to the extended length of travel, a large quantity of semen must be used, on the order of 70–75 ml, containing 2.5 to 5 billion sperm cells.

Surgical experiments have shown that if the boar semen can be inserted into closer proximity to the uterine horns, a reduced number of sperm cells and semen volume may be used. Smaller insemination dosages would reduce the levels of semen collection required, as well as reducing packaging, shipping, and storage costs per dose of semen or embryos. Moreover, in some cases lower quantities of sperm cells may be available, such as when using sexed semen. The sorting of boar sperm cells on the basis of gender takes a long time, for example, about 100 million cells per hour. For a conventional dosage of 3 billion sperm cells, the sexing process would take about 30 hours, yielding a very high cost per insemination. If a reduced dosage of 500 million sperm cells could be employed, the time to perform the sexing is greatly reduced. Or even where the total volume of semen is not reduced, semen of lower fertility, such as frozen semen, may be employed with higher effectiveness. However, surgical insemination is not a practical production technique. The sow reproductive tract is fairly delicate, and extremely prone to damage when subjected to the intrusion of an insemination catheter. The interdigitating processes of the cervix may impede movement of the catheter. An inseminator in haste could potentially push through the cervical wall when trying to pass around the interdigitating processes. Even if such injuries are so minor as to not cause serious harm to the sow, there may be a release of blood into the uterus. Blood however, is incompatible with sperm, and can kill the sperm cells. Moreover, sow insemination is most frequently carried out by personnel who are not veterinarians or specialists. It is therefore desirable that any insemination device be easy to use after a minimum of training. By the same token, transfer of embryos would be facilitated if the embryo can be placed within the sow uterus.

Conventional intrauterine insemination catheters have been formed with a molded plastic blunt end which is attached by a press-fit or adhesive to a narrow flexible tube. However, these molded parts will usually have a parting line, or a joint where they are connected to the tube. This sharp edge is prone to catching on the cervical interdigitating processes or uterine folds, and readily causing injury. The narrow ends or tips of various conventional intrauterine insemination catheters are formed so that puncturing the uterine wall or cervical wall is possible.

What is needed is a device for introducing biological material into a sow which permits embryos or boar semen to be introduced more closely to the uterine horns without injury to the sow.

SUMMARY OF THE INVENTION

The catheter assembly of this invention is for the introduction of biological material into the uterus of a sow, and may alternatively be used for sow insemination or for introduction of swine embryos into the uterus of a sow. The assembly has an internal flexible plastic catheter with a tubular body and an integrally formed protruding head. An axial channel extends from the outside of the sow through the internal catheter and discharges frontwardly of the head. The internal catheter is received within an exterior catheter which has an axial channel which is larger in diameter than the tubular body of the internal catheter, but which is smaller in diameter than the internal catheter head. During introduction of the assembly into the uterus of a sow, the internal catheter head is preferably withdrawn within the forward portion of a resilient tip forming a part of the exterior catheter. The internal catheter head is thereby shielded from clogging until the forward end of the assembly has been positioned as deep as possible within the sow's cervix. At that time the flexible internal catheter is advanced through the tip and into the uterus. The rounded head on the internal catheter is then steered upwards through the external uterine bifurcation into one or the other of the sow's uterine horns. Semen or embryos are then introduced through the axial cavity within the internal catheter and discharged into the uterine body or horn. The cleanliness of the internal catheter prior to discharge of fluid into the uterus may be further preserved by providing the tip on the outer tube with a protective flap which is not penetrated until the internal catheter is advanced past the tip. The internal catheter axial channel may have a constricted portion within the head, permitting semen or embryo containing straws to be positioned therein, for discharge of the contents by a flexible stylette.

It is an object of the present invention to provide a catheter for introducing boar semen or embryos into a sow which is less prone to damaging the tissue in the uterus or the cervix of the sow.

It is a further object of the present invention to provide a sow intrauterine catheter which can be economically produced.

It is an additional object of the present invention to provide a disposable catheter for use in swine Al techniques which can be manipulated with reduced risk of injury to the animal.

It is also an object of the present invention to provide a catheter for sow AI techniques which can be hygienically retained within an outer catheter until the outer catheter is fully inserted into the animal.

It is yet another object of the present invention to provide a catheter assembly which allows straw-packaged biological material to be employed.

Further objects, features and advantages of the invention will be apparent from the following detailed description when taken in conjunction with the accompanying drawings.

DESCRIPTION OF THE PREFERRED EMBODIMENTS

Figure 1:
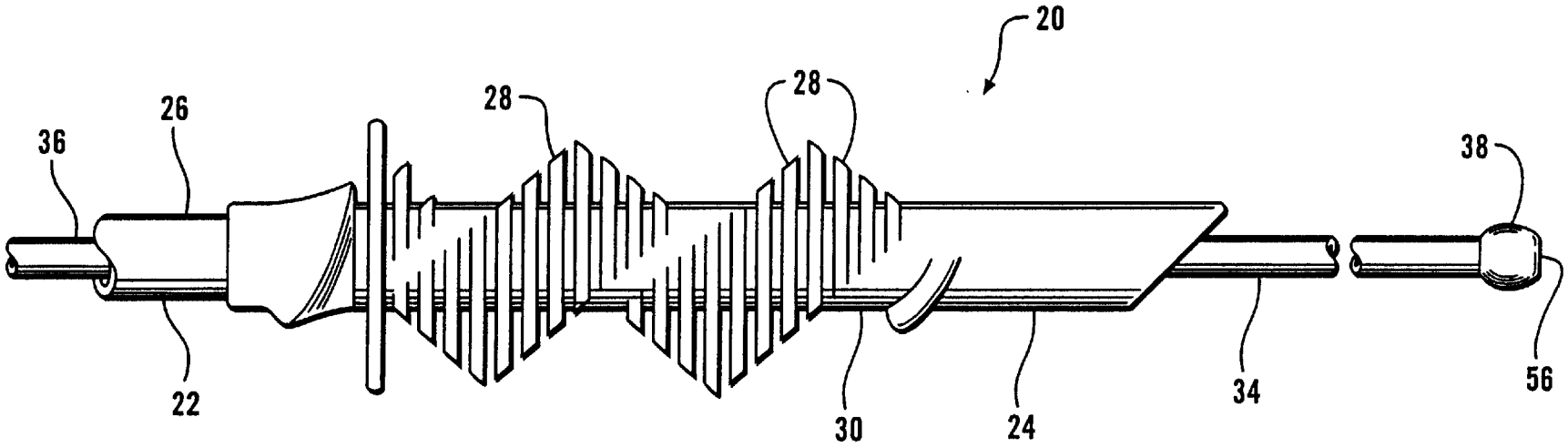
FIG. 1 is a side elevational view of the spiral catheter assembly of this invention.

Referring more particularly to FIGS. 1–9, wherein like numbers refer to similar parts, a catheter assembly 20 for use with sows is shown in FIG. 1. The assembly 20 has an exterior spiral catheter 22 such as the SuperTip™ catheter, available from Minitube of America, Inc., Verona, Wis., U.S.A., http://www.minitube.com. The exterior spiral catheter 22 has a soft plastic spiral tip 24 which is attached to an extruded plastic outer tube 26. Other exterior catheters may be employed, such as the Foamtip™ catheter, also available from Minitube of America, which has a foam end with a tapered front and back. The exterior catheter tip 24 may be about 3¼ inches long and is formed from polyurethane. The tip 24 has a series of closely spaced fins 28 which encircle the shaft 30 of the tip 24 in a helical pattern. However, it should be noted that a traditional solid spiral tip such as the Minitube Spirette™ may also be employed. The exterior catheter outer tube 26 may be about 22 inches long, and has a cylindrical inner cavity 32 which extends the length of the tube 26 and which has an internal diameter of about 4 mm.

Figure 2:
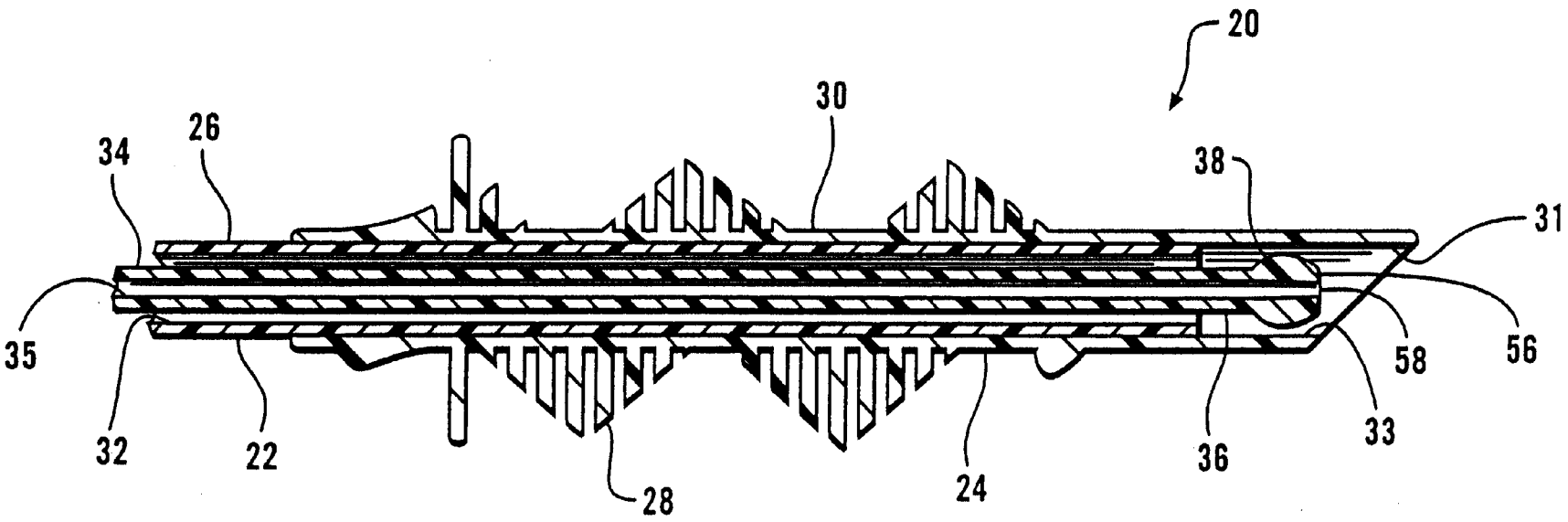
FIG. 2 is a cross-sectional view of the spiral catheter assembly of FIG. 1, shown with the internal catheter withdrawn within the external catheter.

As shown in FIG. 2, the tip 24 has an internal cylindrical cavity 31 which is larger in diameter than the exterior catheter inner cavity 32, and into which the outer tube 26 extends and is molded directly onto the tube. The outer tube 26 does not extend all the way through the tip, leaving a forward segment 33 of the tip cavity 31 which is not occupied by the outer tube.

An internal catheter 34, as shown in FIG. 2, extends through the inner cavity 32 of the exterior catheter 22, and has a flexible tubular plastic body 36 with a rounded head 38 which is retractable within the spiral or foam tip 24 for insertion into a sow, and which protrudes from the spiral tip 24 for controlled introduction of biological material (semen or embryos) into the sow. The internal catheter is telescopically received within the exterior catheter. The body 36 of the internal catheter 34 is an extruded plastic tube, with an exterior diameter of about 3–4 mm, preferably about 3.0 mm. The head 38 extends axially about 5 mm, is generally spheroid, and has a diameter of 4–6 mm, for example about 4.5 to 5 mm. The internal catheter 34 is formed as a unitary plastic element, preferably of a mixture of polypropylene and Ethylenevinyl Acetate (EVA) resins. The internal catheter 34 may be about 80 cm to 100 cm in length. The internal catheter 34 is formed to have an axial central channel 35 which extends from an exterior end 48 to a forward end 56 of the catheter head 38. The central channel 35 may have a diameter of about 1.72 mm. The central channel 35 may stay a constant diameter as it extends through the head 38 of the internal catheter and exits at the discharge opening 58, or it may narrow somewhat.

Because of the necessity of maintaining the cleanliness of instruments involved in artificial insemination and embryo transfer techniques, the assembly 20 is entirely disposable, and hence must be manufactured at a low cost. As shown in FIG. 2, prior to insertion into the sow, the internal catheter 34 is retracted within the exterior catheter 22, such that the internal catheter head 38 is withdrawn within the forward segment 33 of the tip cavity 31 of the exterior catheter tip 24. The assembly will preferably be packaged within a sealed plastic bag and sterilized, such as by gamma irradiation, to assure its cleanliness prior to use. It will be noted that the maximum diameter of the internal catheter head 38 is greater than the diameter of the cylindrical inner cavity 32 of the outer catheter tube 26. Hence, the internal catheter head 38 may be withdrawn into the forward segment 33 of the tip cavity, but it may not be withdrawn into the inner cavity of the exterior catheter. As a result, the internal catheter 34 can only leave the exterior catheter frontwardly. This arrangement is an aid to the use of the assembly 20, as it frees the operator from constantly maintaining control of the internal catheter to prevent its rearward escape from the exterior catheter 22. It should be noted that, alternatively, the head 38 of the internal catheter 34 could be larger than the internal diameter of the internal cylindrical cavity 31 of the tip, but as the tip is formed of a resilient material, could still be withdrawn within the tip. In another alternative embodiment, the head 38 may be sufficiently large that it cannot be withdrawn at all into the tip 24.

Figure 3:
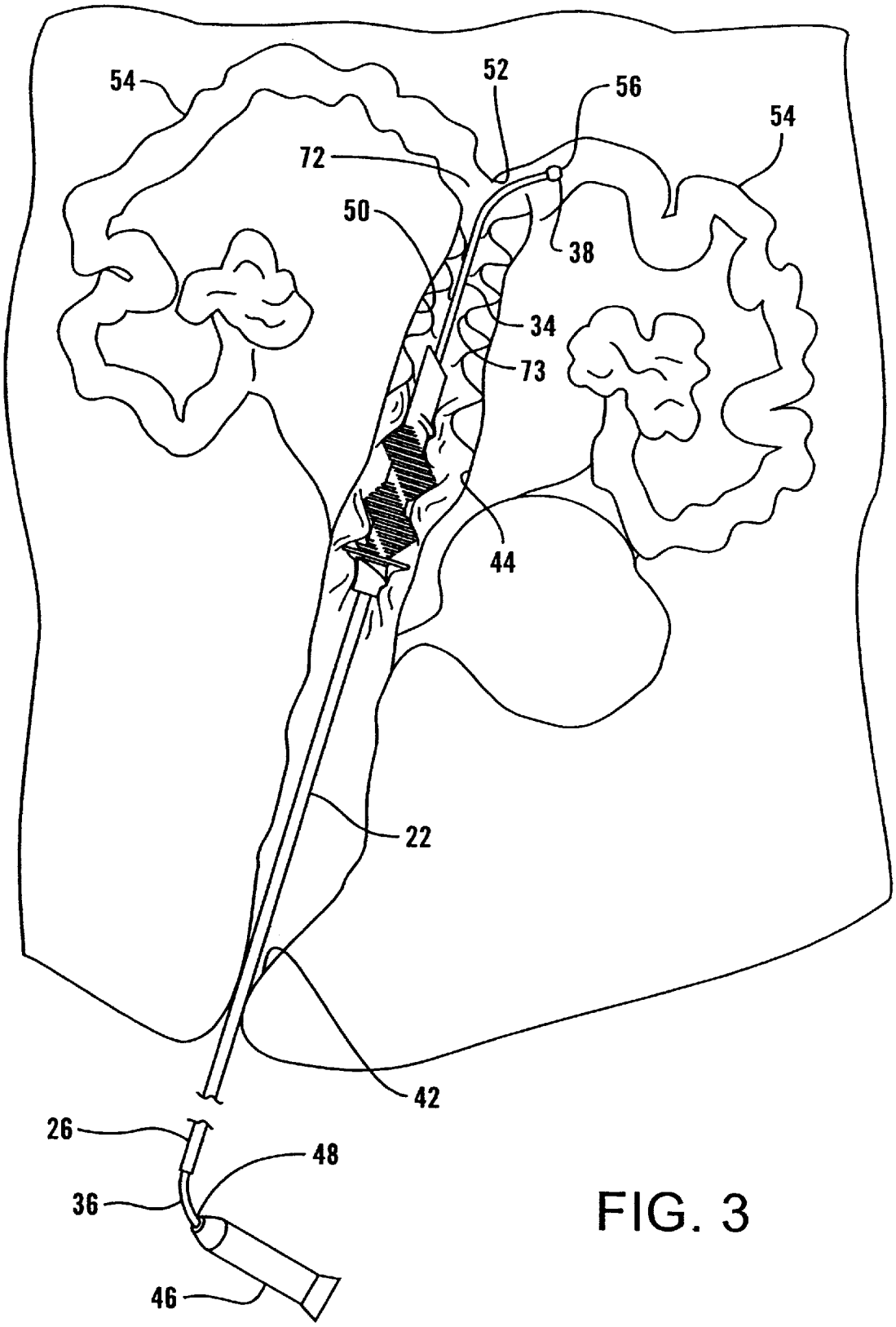
FIG. 3 is a schematic cross-sectional view of a sow's reproductive tract with the catheter assembly of FIG. 1 inserted therein for artificial insemination.

When a sow has been determined to be in heat in the conventional fashion, and is ready for treatment, the catheter assembly 20 is removed from its package and the forward end of the exterior catheter 22 is inserted into the sow's vagina 42 by rotating the spiral tip 24 in a counterclockwise fashion. If a foam tip without a spiral is used, such as the one shown in FIG. 4, then rotation is not required. The exterior catheter 22 is advanced until a lock has been established in the cervix 44, as shown in FIG. 3. The operator then grasps the exterior end 48 of the internal catheter 34 and urges the internal catheter forwardly through the exterior catheter 22, advancing the internal catheter head 38 out of the tip 24 and into the cervix and uterus 50 of the sow. The protruding rounded head 38 serves to advance the internal catheter through the interdigitating processes 73.

The operator should have experience with artificial insemination techniques and a solid understanding of the configuration of a sow's reproductive tract. The rounded head 38 of the internal catheter 34 minimizes the chances that the delicate tissue of the sow's cervix or uterus 50 may be damaged or traumatized. Moreover, the unitary construction of the internal catheter 34 presents a catheter structure without ridges, sharp edges, flashing or sprue which could catch on or cut and damage the mucus membrane of the uterus. In addition, the tubular body 36 of the internal catheter must be sufficiently resilient that it will bend to work its way through the curved geometry of the sow's reproductive tract, yet sufficiently rigid that it will not turn back onto itself. The skilled operator will realize that the position of various features of the sow's reproductive tract will vary depending on a number of factors, for example, the age and reproductive history of the sow, the presence of cervical or uterine scarring as a result of previous illness or reproductive difficulties, etc. In certain situations, the apparatus 20 may not be effective, for example with very young gilts and with sows having excessive scarring caused by dystocia.

By responding to the pressure perceived on the internal catheter as it is advanced into the uterus, the operator manipulates the internal catheter to insert the internal catheter head 38 through the uterine body 72 through the external uterine bifurcation 52 and into one or the other of the two uterine horns 54. By gentle operation of the internal catheter 34 the head 38 may be positioned within a uterine horn 54 without causing uterine bleeding. It is desirable to avoid any bleeding, as blood can interfere with fertility.

When the internal catheter 34 head 38 is determined to be in a desired location within a uterine horn 54, a container 46 filled with the semen or embryos, usually in some carrier medium, is secured to the exterior end 48 of the internal catheter 34 tubular body 36 to communicate with the central channel 35. The container 46 may be connected to the exterior end 48 of the internal catheter 34 by providing a flare or enlargement of diameter on the exterior end of the internal catheter, and receiving therein a spike of the container 46. Alternatively, the unflared cylindrical end of the internal catheter may be inserted into the spike of the container 46.

The semen or embryos are then ejected from the container 46. The liquid travels through the central channel 35 out of the forward end of the internal catheter head 38 through the discharge opening 58 and into the sow uterine horn 54. Once the container 46 has been exhausted, to insure delivery of the entire quantity of biological material, the channel 35 may be flushed with a flushing agent such as sodium citrate or other clear medium.

It will be expected that, by delivering semen or embryos to a location closer to where they will be taken up, greater effectiveness can be obtained. For example, semen which has been frozen may be less viable than semen which has never been frozen, but, by being positioned further within the sow uterus may still be effective. Likewise, sexed semen, which may be also less viable and may be difficult or costly to produce in larger quantities, may be employed in smaller quantities by being positioned at such a closer location. And other situations, where it is desired to inseminate a multiplicity of sows from a single boar semen collection, usage of the apparatus 20 may permit smaller quantities of semen to be used.

As discussed above, the integral construction of the internal catheter minimizes possible trauma to the sow by eliminating sharp edges on the catheter head. In addition, by having only a single piece, the need to employ solvents or glues, which may be toxic, is also eliminated. In addition, the possibility that a portion of the catheter could break off or become lodged within the animal is eliminated.

The integral internal catheter may be formed from a single length of extruded plastic tubing. The manufacture of the catheter begins by inserting a length of extruded tubing generally of the same dimensions as the final internal catheter body 36 into a rigid pipe having an internal diameter which mates with the external diameter of the tubing to permit the tubing to be advanced and retracted and rotated within the pipe.

The rigid pipe is fixed adjacent to a heat source, and the forward ¾ inch segment of the tubing is extended beyond the pipe, while the tubing is continuously rotated for example by an electric motor or the equivalent, at about 150 rpm. The heat source is sufficient to elevate the temperature of the tubing to about 222° C. The spinning of the tubing maintains the symmetrical shape of the part. The tubing is rotated and retracted and advanced as necessary to evenly heat the forward segment. While the heat heat is applied to the rotating tubing, the opaque tubing becomes translucent, indicating that it is approaching the melting point of the plastic. As it rotates, the memory effect takes place and the cylindrical tubing opens up like a funnel. This expansion causes an enlargement of the forward segment diameter while maintaining the internal channel that extends therethrough. The end of the tubing then begins to wobble, and begins wagging like a tail. Once the funnel is sufficiently large, it is centered along the axis of the tube, in line with the rest of the tube. It then gains shape and closes off the funnel into the enlarged head of the internal catheter. The tubing is then cooled while continuing to rotate the rod. The initial heating time is five seconds, the wobbling time is four seconds, the time for gaining the shape and closing the funnel to a spherical end takes 11–14 seconds, and the cooling time is about 10 seconds. A memory effect causes the plastic tubing to expand as it is heated. However, as the heat increases, the plastic will collapse upon itself. By adjusting the position of the forward segment of the tubing, the time over the heat source, and the rotation, the desired head shape may be obtained. It will be noted that an internal catheter head can then be formed with a discharge opening 58 which is the same diameter as the axial central channel 35, a larger diameter, or a smaller diameter. Alternatively, if it is desired to have a constant diameter channel 35, a pin may be inserted which is the dimension of the desired channel, while the part is being formed.

The forming process just described has the advantage over, for example an injection molding process, in that no flashing or sprue is present on the finished part, and hence no trimming, sanding or polishing is required to achieve the finished part. Alternatively, the head may be formed on the extruded plastic tubing by a progressive series of dies which may be applied to the heated end of the tubing to form it into the desired shape.

Figure 4:
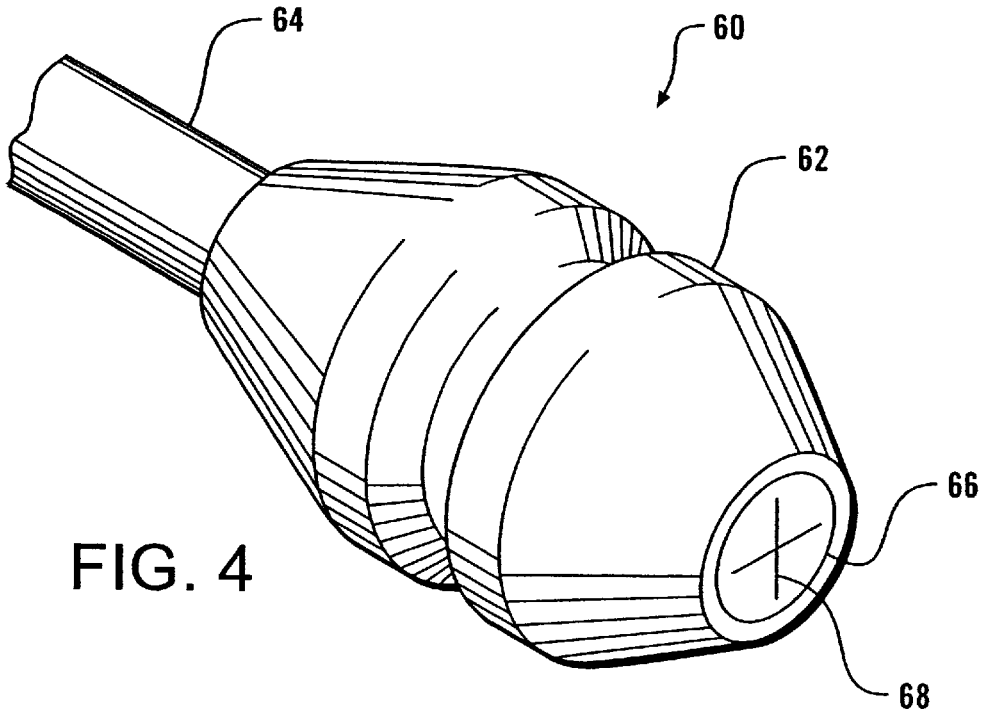
FIG. 4 is a fragmentary isometric view of an alternative embodiment catheter assembly of this invention, showing a foam tip catheter with a front flap.
Figure 5:
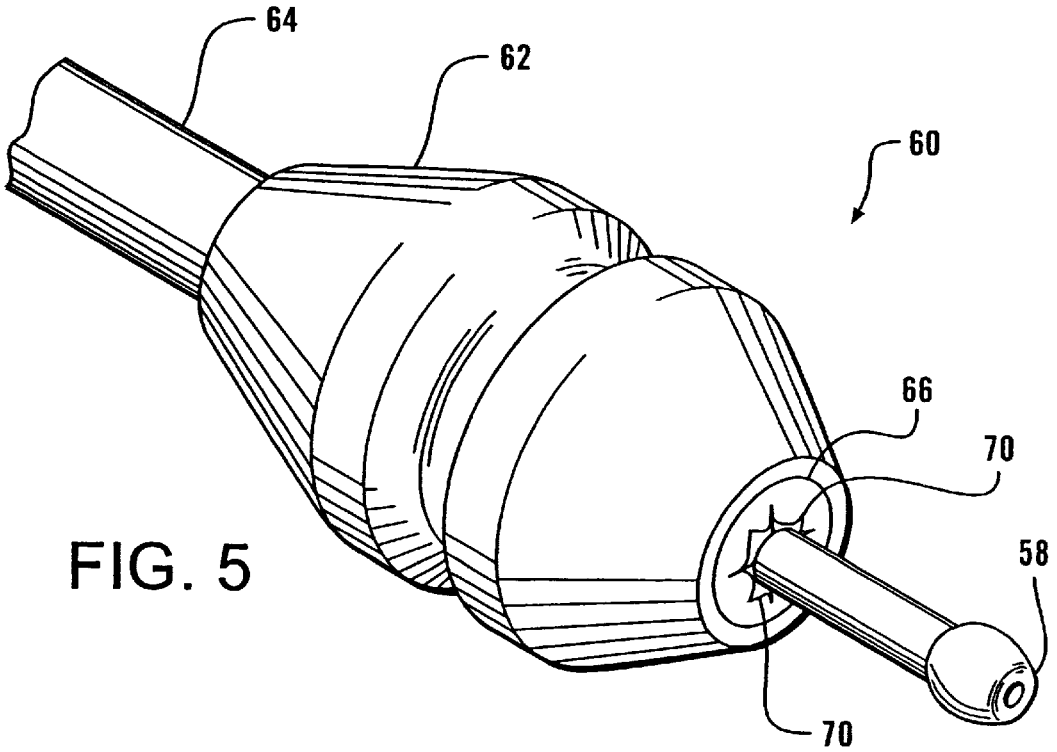
FIG. 5 is a fragmentary isometric view of the assembly of FIG. 4 showing the internal catheter protruding through the front flap.

As noted above, it is desirable to maintain hygienic conditions during the introduction of biological material into the sow. The need for cleanliness is increased when material is being deposited at advanced locations within the uterus. By retracting the internal catheter head within the foam or spiral tip, the end of the internal catheter is generally protected from becoming clogged or contaminated by material exterior to the sow or in advance of the uterus. Even greater protection may be achieved by forming the exterior catheter tip with one or more flaps which close off the forward end of the tip until the internal catheter head is projected through the tip. An alternative embodiment exterior catheter 60 is shown in FIGS. 4 and 5. The catheter 60 has a foam tip 62 which is fixed to an extruded plastic outer tube 64. Although the foam tip 62 is shown having a generally tapered cylindrical form, it may also have the spiral form as disclosed above.

As shown in FIG. 4, the foam tip 62 has a thin sheet of material at its forward end which defines a flap 66 or barrier which shields the internal catheter 34 while it is withdrawn within the tip 62. A cross-shaped slit 68 may be formed in the flap 66 to divide it into four smaller flaps 70. As shown in FIG. 5, when the internal catheter 34 is advanced from the exterior catheter 60, the internal catheter head 38 passes through the slit 68, pushing aside the flaps 70 and any material on the flaps, and then protrudes from the foam tip 62. The slit may be placed in other positions on the flap 66, for example, the slit may be a semicircular one around the perimeter of the front opening in the foam tip, so as to define a single flap which can then fold out of the way of the internal catheter head. Alternatively, if the flap 66 is made sufficiently thin, the slit may be dispensed with altogether, and the internal catheter may be made to puncture the flap when needed.

Figure 6:
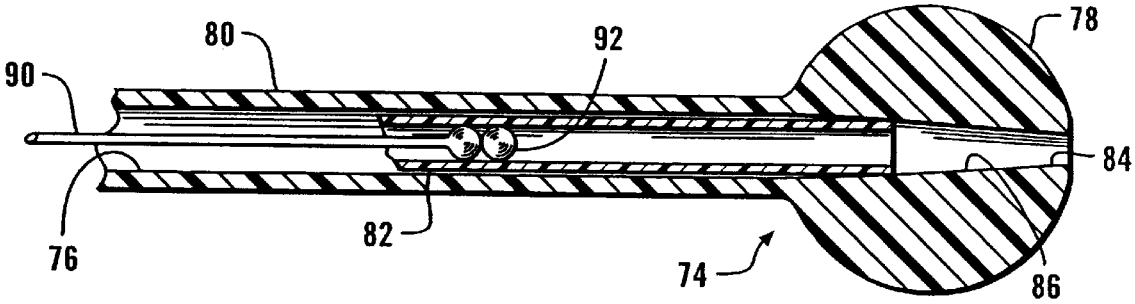
FIG. 6 is a cross-sectional view of an alternative embodiment internal catheter assembly of this invention having an axial channel with a constricted portion adapted to receive a straw within the interior channel.

An alternative embodiment internal catheter 74 is shown in FIG. 6. The internal catheter 74 is similar to the internal catheter 34 discussed above, and is used with the same exterior catheter 22. While the assembly 20, discussed above is particularly useful for fresh, that is, never frozen, semen and embryos, the internal catheter 74 is advantageously used with previously frozen semen and embryos. The internal catheter 74 has an axial central channel 76 which narrows in diameter as it extends through the head 78. In addition, the internal catheter 74 preferably has a larger diameter central channel 76, for example about 2.1 mm, and a larger tubular body 80 exterior diameter of about 4.1 mm. The internal catheter 74 is used in conjunction with a plastic straw 82 which has been filled with biological material such as embryos or semen. Material prepackaged in a straw 82 may be preferably used when it is desired to ensure that the full quantity of biological material exits the discharge opening 84 of the internal catheter head 78. For example, with a very small swine embryo the need to flush the central channel of the internal catheter may be lessened by positioning the embryo within a straw in close proximity to the discharge opening. Embryos may be packaged in straws having a capacity of about ¼ cc. The narrowing diameter central channel 76 defines a constricted portion 86 within the head 78. The constricted portion 86 thus narrows to a diameter which is smaller than the exterior diameter of the cylindrical straw 82. The head 78 of the internal catheter 74 having the constricted portion 86 may be formed utilizing the same processes described above with respect to the internal catheter 34. By alternating heating and rotating it is possible to achieve an axial central channel 76 with the desired amount of constriction.

The straw 82 may be of the type conventionally used for storage and transport of semen. The plastic straw, prior to use, is sealed at one end by a fusing of the plastic walls, and is sealed at the other end by a plug which is a metal spherical ball 92 slightly larger in diameter than the cylindrical internal diameter of the straw. The ball is pressed into place and prevents escape of material from the straw. The straw may also, instead of the spherical ball, have what is known as a "factory seal." In such a straw the plug is formed by a small quantity of cotton, followed by a quantity of powder and then a quantity of cotton. When a vacuum is drawn through the factory seal, liquid is drawn into the straw. Once the liquid reaches the powder, the powder becomes a gel which prevents air or liquid from entering or leaving through the seal. The factory seal plug can be advanced through the straw by a stylette in a fashion similar to the ball seal. To use the internal catheter 74, a straw containing the desired biological material is cut open at one end and inserted into the exterior end, not shown, of the internal catheter 74. The external diameter of the straw 82 is slightly smaller than the internal diameter of the central channel 76 which allows the open straw to be advanced along the central channel 76 by means of, for example, a conventional flexible steel stylette 90. As the biological material is packaged within the straw 82 without an air bubble, atmospheric pressure will retain the biological material within the open straw as the open end of the straw abuts within the constricted portion 86. The constricted portion 86 seals off the open end of the straw once inserted, so that the contents of the straw can only move forwardly through the axial channel 76. In addition, the narrowed diameter of the channel prevents the straw itself from being pushed out through the discharge opening 84.

The straw containing, for example, thawed semen or embryos is inserted into the internal catheter only after the catheter has been positioned within the sow. Once the straw 82 is in position within the internal catheter 74 which has been inserted within the sow as discussed above, the stylette 90 is then used to push the movable proximal plug 92 of the opened straw towards the open distal end of the straw. The ball 92 moves through the straw to thereby eject the biological material, such as semen or an embryo within some medium, into the constricted portion 86 of the internal catheter head 78 and from there out of the discharge opening 84 into the sow.

Thereafter, the stylette 90 may be retracted, while the internal catheter remains in place, to extract the empty straw from within the catheter 74. A sphere shaped end on the end of the stylette 90 creates enough friction and contact against the inner surface of the expended straw so that by withdrawing the stylette from the internal catheter it will also remove that straw from the internal catheter. Once the stylette is completely out of the internal catheter, the straw can be pulled off its distal end and the procedure can be repeated with another straw being inserted into the internal catheter which at that time is still in-situ. If desired, the central channel 76 of the internal catheter 74 may then be flushed. This approach may be particularly useful when employing frozen sperm cells which will generally be more concentrated, as the semen is centrifuged prior to freezing.

Figure 7:
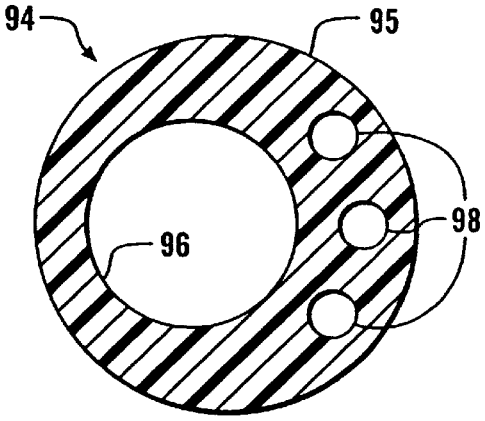
FIG. 7 is a cross-sectional view of an alternative embodiment internal catheter having a plurality of fluid channels.
Figure 8:
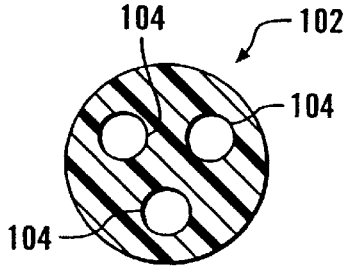
FIG. 8 is cross-sectional view of another alternative embodiment internal catheter having three fluid channels.
Figure 9:
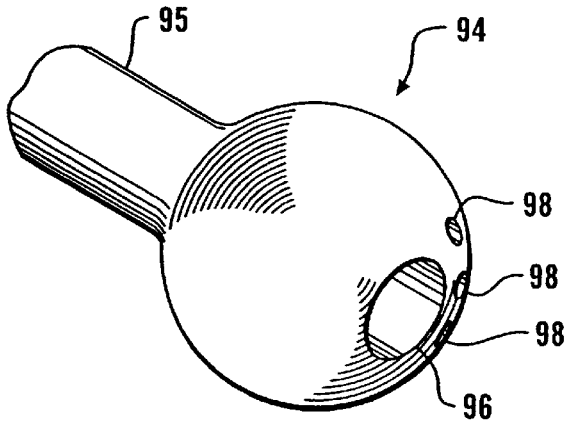
FIG. 9 is a fragmentary isometric view of the head of the internal catheter of FIG. 7.

Alternative embodiment internal catheters having multiple channels are shown in FIGS. 7–9. An internal catheter 94, shown in FIG. 7 and FIG. 9, is similar to the internal catheter 34 with the difference that the main internal channel 96 is off center and three smaller side channels 98 extend parallel to the main internal channel 96 within the extruded plastic body 95. As shown in FIG. 9, the internal catheter 94 has a protruding head 100 through which all the channels 96, 98 discharge. The main internal channel 96 may be provided with a constricted portion as discussed with respect to the internal catheter 74 to receive a straw therein. The internal catheter 94 may be used as described with respect to the internal catheter 74 for introducing biological material, however, the side channels 98 may be used for introducing additional fluid, such as a reconstituting fluid, without the need to first remove the straw. Alternatively, the side channels could be used for introducing embryos or semen as well. The internal catheter 94 may be produced as described with respect to the catheter 34. However, in some cases it may be necessary to introduce air pressure into the channels before the plastic cools down in the heating and rotating process, to blow the channels open at the head.

Another alternative embodiment internal catheter 102, shown in FIG. 8 has three similar channels 104, and may be used to introduce various elements into the sow uterus, for example, semen and one or more charges of extender or flushing solution.

It should be noted that the enlarged diameter head of the internal catheter, in addition to serving to prevent injury, also functions as a dilator. This is particularly beneficial in sows which have not yet given birth, where there is a very small opening into the uterus. The larger head expands the small opening. The surrounding tissue will not immediately return into the expanded opening, thus leaving a slightly larger opening for the body of the internal catheter to pass through, and reducing the friction on the catheter as it is manipulated within the uterus. This reduced friction facilitates positioning of the internal catheter, as the operator does not have to consider as much the effects of friction in assessing the resistance to forward movement of the internal catheter, the whole instrument thus becomes more sensitive, giving the operator a better feel of its progress.

It is understood that the invention is not limited to the particular construction and arrangement of parts herein illustrated and described, but embraces all such modified forms thereof as come within the scope of the following claims.

I claim:

1. A catheter assembly for introduction of biological material into the uterus of a sow, the catheter assembly comprising:

an outer tube having a forward end for positioning within a sow and a rearward end which is positionable to protrude from the sow;

a tip fixed to the forward end of the outer tube; and a flexible inner tube which extends within the outer tube, the inner tube having a forward end with a projecting head, wherein portions of the inner tube and the head define a central channel which extends axially along the inner tube, the central channel extending through the head and opening frontwardly of the head at a discharge opening, wherein the inner tube has a first exterior diameter, and wherein the head has a maximum exterior diameter which is greater than the first exterior diameter, and wherein the head is integrally formed with the inner tube.

2. The catheter assembly of claim 1 wherein the outer tube has an interior diameter, and an exterior diameter, and wherein the inner tube head maximum exterior diameter is greater than the outer tube interior diameter to restrict the retraction of the head into the outer tube.

3. The catheter assembly of claim 2 wherein the tip has an axial passage therethrough with a diameter greater than the outer tube interior diameter, and wherein portions of the tip protrude frontwardly from the outer tube such that the inner tube head is retractable within the tip but not within the outer tube.

4. The catheter assembly of claim 1 wherein the tip has an axial passage therethrough, and wherein portions of the tip define at least one front flap which overlies and obstructs the axial passage, such that the inner tube and head are capable of being withdrawn within the axial passage, and being shielded therein by the at least one flap from contact with material exterior and frontward of the tip, until such time as the head is advanced to protrude through the at least one front flap to a position forward of the tip.

5. The catheter assembly of claim 1 wherein the central channel has portions which narrow in diameter ahead of the head discharge opening, such that a cylindrical straw is positionable within the central channel but cannot progress through the discharge opening.

6. The catheter assembly of claim 1 further comprising portions of the inner tube which define at least one second channel, extending parallel to the central channel, and also extending through the head.

7. A catheter assembly for introduction of biological material into the uterus of a sow, the catheter assembly comprising:

an exterior catheter having a forward end for positioning within a sow and a rearward end which is positionable to protrude form the sow;

a flexible internal catheter which extends within the exterior catheter, the internal catheter having a tubular body and a forward end with a projecting head and portions which define an axially extending central channel which opens frontwardly of the head, wherein the tubular body has a first exterior diameter, and wherein the head has a maximum exterior diameter which is greater than the first exterior diameter, and wherein the head is integrally formed with the inner tube such that there is no sharp projection from the head.

8. The catheter assembly of claim 7 wherein the exterior catheter has an outer tube and a forward tip, and the outer tube has an interior diameter and an exterior diameter, and wherein the head maximum exterior diameter is greater than the outer tube interior diameter to restrict the retraction of the head into the outer tube.

9. The catheter assembly of claim 8 wherein the tip has an axial passage therethrough with a diameter greater than the outer tube interior diameter, and wherein portions of the tip protrude frontwardly from the outer tube such that the internal catheter head is retractable within the tip but not within the outer tube.

10. The catheter assembly of claim 7 wherein the exterior catheter has a forward tip with an axial passage therethrough, and wherein portions of the tip define at least one front flap which overlies and obstructs the axial passage, such that the internal catheter is capable of being withdrawn within the axial passage, and being shielded therein by the at least one flap from contact with material exterior and frontward of the tip, until such time as the head is advanced to protrude through the at least one front flap to a position forward of the tip.

11. The catheter assembly of claim 7 wherein the central channel has portions which narrow in diameter ahead of the head discharge opening, such that a cylindrical straw is positionable within the central channel but cannot progress through the discharge opening.

12. The catheter assembly of claim 7 further comprising portions of the internal catheter which define at least one second channel, extending parallel to the central channel, and also extending through the head.

13. A catheter assembly for introduction of biological material into the uterus of a sow, the catheter assembly comprising:

an exterior catheter having a forward end for positioning within a sow and a rearward end which is positionable to protrude from the sow;

a flexible internal catheter which extends within the exterior catheter, the internal catheter having a tubular body and a forward end with a radially projecting head and portions which define an axially extending first channel which opens frontwardly of the head at a discharge opening, wherein the first channel has a first section of at least a first diameter, and a constricted portion which communicates with the first section, the constricted portion narrowing in diameter as it extends towards the discharge opening;

a straw containing biological material, the straw having a diameter which is less than the first diameter, but greater than the narrowest diameter of the constricted portion, such that the straw is received within the first channel while being prevented from exiting through the discharge opening by the constricted portion.

14. The catheter assembly of claim 13 further comprising portions of the internal catheter which define at least one second channel, extending parallel to the central channel, and also extending through the head.

15. The catheter assembly of claim 13 wherein the exterior catheter has an interior diameter, an exterior diameter, and a tip, and wherein the internal catheter head has a maximum exterior diameter which is greater than the exterior catheter interior diameter to restrict the retraction of the head into the exterior catheter.

16. The catheter assembly of claim 13 wherein the forward end of the external catheter has a foam tip with an axial passage therethrough, and wherein portions of the tip define at least one front flap which overlies and obstructs the axial passage, such that the internal catheter is capable of being withdrawn within the axial passage, and being shielded therein by the at least one flap from contact with material exterior and frontward of the tip, until such time as the internal catheter head is advanced to protrude through the at least one front flap to a position forward of the tip.

17. A method for introducing biological material into the uterus of a sow, comprising the steps of:

inserting a tip of an exterior catheter having an axial inner cavity into the cervix of the sow;

advancing an internal catheter through the axial inner cavity, the internal catheter having a tubular body and a forward end with a radially projecting head which is integrally formed with the tubular body and portions which define an axially extending first channel which opens frontwardly of the head at a discharge opening, manipulating the internal catheter through the uterus of the sow until the internal catheter discharge opening is at a desired position within the reproductive tract of the sow;

introducing a quantity of biological material into the first channel of the internal catheter, and discharging the biological material through the discharge opening;

retracting the internal catheter within the exterior catheter; and removing the exterior catheter and the internal catheter from within the sow.

18. The method of claim 17 wherein the internal catheter first channel has a first section of at least a first diameter, and a constricted portion which narrows below the first diameter as it extends toward the discharge opening, and wherein the step of introducing the quantity of biological material comprises the steps of:

introducing a straw containing biological material into the first section of the internal catheter first channel, the straw having a diameter less than the first diameter but greater than the smallest diameter of the constricted portion, such that the straw cannot escape through the discharge opening; and inserting a stylette through the first channel to eject the biological material from the straw into the constricted portion of the first channel and out the discharge opening.

19. The method of claim 17 wherein the biological material includes boar semen.

20. The method of claim 17 wherein the biological material includes at least one swine embryo.

21. The method of claim 17 wherein the exterior catheter tip protrudes radially and has at least one flap that obstructs at least a portion of an opening in the tip, and wherein the step of advancing the internal catheter through the axial inner cavity, includes the step of advancing the head of the internal catheter past the at least one flap.

22. The method of claim 17 wherein the internal catheter has at least one second axial channel which extends through the head, and further comprising the step of introducing a fluid through the at least one second channel after the step of introducing the quantity of biological material.

* * * * *